US007425239B2

(12) United States Patent
Ogawa et al.

(10) Patent No.: US 7,425,239 B2
(45) Date of Patent: Sep. 16, 2008

(54) FE-BASED AMORPHOUS ALLOY RIBBON

(75) Inventors: Yuichi Ogawa, Saitama-ken (JP); Masamu Naoe, Saitama-ken (JP); Yoshihito Yoshizawa, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 362 days.

(21) Appl. No.: 11/059,303

(22) Filed: Feb. 17, 2005

(65) Prior Publication Data

US 2006/0000524 A1 Jan. 5, 2006

(30) Foreign Application Priority Data

Jul. 5, 2004 (JP) ..... 2004-198196
Jan. 11, 2005 (JP) ..... 2005-003882

(51) Int. Cl.
*H01F 1/00* (2006.01)
*C22C 45/00* (2006.01)

(52) U.S. Cl. ..... 148/304; 148/403

(58) Field of Classification Search ..... 148/304, 148/403
See application file for complete search history.

(56) References Cited

U.S. PATENT DOCUMENTS

| | | | | |
|---|---|---|---|---|
| 4,219,355 | A * | 8/1980 | DeCristofaro et al. | 148/304 |
| 4,437,907 | A * | 3/1984 | Sato et al. | 148/304 |
| 5,011,553 | A * | 4/1991 | Ramanan | 148/403 |
| 5,593,513 | A * | 1/1997 | Ramanan et al. | 148/304 |
| 5,593,518 | A * | 1/1997 | Ramanan | 148/304 |
| 5,871,593 | A | 2/1999 | Fish et al. | |
| 6,359,563 | B1 | 3/2002 | Herzer | |

FOREIGN PATENT DOCUMENTS

| | | |
|---|---|---|
| EP | 0 055 327 | 7/1982 |
| JP | 5-140703 | 6/1993 |
| JP | 2002-285304 | 10/2002 |
| WO | 00/48152 | 8/2000 |

* cited by examiner

*Primary Examiner*—Roy King
*Assistant Examiner*—Caitlin Fogarty

(57) ABSTRACT

An Fe-based amorphous alloy ribbon having a composition comprising $Fe_aSi_bB_cC_d$ and inevitable impurities, wherein a is 80 to 83 atomic %, b is 0.1 to 5 atomic %, c is 14 to 18 atomic %, and d is 0.01 to 3 atomic %, the concentration distribution of C measured radially from both surfaces to the inside of said Fe-based amorphous alloy ribbon having a peak within a depth of 2 to 20 nm.

13 Claims, 5 Drawing Sheets

FE-BASED AMORPHOUS ALLOY RIBBON

FIELD OF THE INVENTION

The present invention relates to an Fe-based amorphous alloy ribbon having a high magnetic flux density and a low core loss, suitable for magnetic cores for transformers, motors, generators and choke coils, magnetic sensors, etc.

BACKGROUND OF THE INVENTION

Fe-based amorphous alloy ribbons have been attracting much attention for magnetic cores for transformers because of excellent soft magnetic properties, particularly low core loss. Particularly amorphous Fe—Si—B alloy ribbons having high saturation magnetic flux densities $B_S$ and excellent thermal stability are used for magnetic cores for transformers. However, the Fe-based amorphous alloy ribbons are poorer than silicon steel plates presently used mostly for magnetic cores for transformers in saturation magnetic flux density. Thus, development has been conducted to provide Fe-based amorphous alloy ribbons with high saturation magnetic flux densities. To increase the saturation magnetic flux density, various attempts have been conducted: the amount of Fe contributing to magnetization is increased; the decrease of thermal stability due to increase in the amount of Fe is compensated by adding Sn, S, etc.; and C is added.

JP 5-140703 A discloses an amorphous Fe—Si—B—C—Sn alloy having a high saturation magnetic flux density, in which Sn serves to make the high-Fe-content alloy amorphous. JP 2002-285304 A discloses an amorphous Fe—Si—B—C—P alloy having a high saturation magnetic flux density, in which P serves to make the alloy having a drastically increased Fe content amorphous.

It is important that practical magnetic cores have a high magnetic flux density at a low magnetic field, namely a high squareness ratio $B_{80}/B_S$, in which $B_{80}$ represents a magnetic flux density in a magnetic field of 80 A/m. What is practically important for magnetic cores for transformers is that the transformers are operated at a high magnetic flux density. The operating magnetic flux density is determined by the relation between a magnetic flux density and a core loss, and should be lower than the magnetic flux density from which the core loss increases drastically. Even with the same saturation magnetic flux density, Fe-based amorphous alloy ribbons having low $B_{80}/B_S$ would have increased core losses at high operating magnetic flux densities. In other words, Fe-based amorphous alloy ribbons having higher $B_{80}$ and lower core losses in high magnetic flux density regions can be operated at higher operating magnetic flux densities. However, Fe-based amorphous alloy ribbons having $B_{80}$ of more than 1.55 T are not mass-produced at present. The reason therefor is that if alloy ribbons having high saturation magnetic flux densities contain more than 81 atomic % of Fe, they cannot be mass-produced stably because of surface crystallization and thermal stability decrease. To solve such problems, attempts have been conducted to improve surface crystallization and thermal stability by adding Sn, S, etc. Though these means can improve alloy's properties, the resultant ribbons are brittle, and ribbons having additives distributed uniformly cannot be produced continuously. For these reasons, such amorphous alloy ribbons cannot be mass-produced. Though C-containing alloys having an Fe content of 81 atomic % can be mass-produced, they have $B_{80}$ of 1.55 T or less. In addition, embrittlement, surface crystallization and thermal stability decrease are serious problems for Fe-based amorphous alloy ribbons containing 81 atomic % or more of Fe. Though the addition of C and P can improve saturation magnetic flux densities, the resultant ribbons are so brittle that they cannot be easily formed into transformers.

As described above, despite the effort of improving the saturation magnetic flux densities of Fe-based amorphous alloy ribbons, Fe-based amorphous alloy ribbons having $B_{80}$ of 1.55 T or more and core losses $W_{14/50}$ of 0.28 W/kg or less when measured on toroidal cores have not been stably produced so far, because of embrittlement, surface crystallization and squareness ratio decrease, etc.

OBJECT OF THE INVENTION

Accordingly, an object of the present invention is to provide an Fe-based amorphous alloy ribbon having a high saturation magnetic flux density and a low core loss, which is provided with high $B_{80}/B_S$, excellent thermal stability and suppressed embrittlement by controlling a weight ratio of Si to C and the roughness of a roll-contacting surface, and by controlling the range and peak of a C-segregated layer from a free surface and a roll-contacting surface by the amount of a gas blown onto a roll.

SUMMARY OF THE INVENTION

The Fe-based amorphous alloy ribbon of the present invention has a composition comprising $Fe_aSi_bB_cC_d$ and inevitable impurities, wherein a is 80 to 83 atomic %, b is 0.1 to 5 atomic % or less c is 14 to 18 atomic %, and d is 0.01 to 3 atomic %, the concentration distribution of C measured radially from both surfaces to the inside of the Fe-based amorphous alloy ribbon having a peak within a depth of 2 to 20 nm. Namely, there is a C-segregated layer at a depth of 2 to 20 nm from each of the free surface and roll-contacting surface of the Fe-based amorphous alloy ribbon.

More preferably, a, b and d meet the condition of $b=(0.5\times a-36)\times d^{1/3}$, so that the Fe-based amorphous alloy ribbon has a saturation magnetic flux density $B_s$ of 1.60 to 1.689 T and a magnetic flux density $B_{80}$ of 1.55 to 1.66 T after annealing.

An annealed toroidal core constituted by the Fe-based amorphous alloy ribbon of the present invention preferably has a core loss $W_{14/50}$ of 0.227 to 0.28 W/kg at a magnetic flux density of 1.4 T and a frequency of 50 Hz.

The Fe-based amorphous alloy ribbon of the present invention preferably has a breaking strain $\epsilon$ of 0.02 to 0.05 after annealing. The breaking strain $\xi$ is calculated by $\epsilon=t/(2r-t)$, wherein t represents the thickness of the ribbon, and r represents a breaking radius of the ribbon in a bending test. As shown in FIG. 6, the bending test is carried out by placing a bent alloy ribbon 10 between a pair of parallel plates 20, 21, keeping two parts of the alloy ribbon 10 parallel (180°), and lowering an upper plate 20 horizontally to gradually bend the alloy ribbon 10 to a smaller angle, thereby measuring the distance D (=2r) between the two plates 20, 21 at a time when the alloy ribbon 10 is broken (indicated by 12). If the alloy ribbon is bendable to 180°, then $\epsilon=1$.

The Fe-based amorphous alloy ribbon can be produced by blowing a CO or $CO_2$ gas in a predetermined amount onto a roll during casting, such that a roll-contacting surface of the Fe-based amorphous alloy ribbon has an average surface roughness Ra of 0.6 μm or less. The average surface roughness Ra is determined by arithmetically averaging five data of surface roughness measured by a surface profilometer.

DETAILED DESCRIPTION OF THE PREFERRED EMBODIMENTS

Figure 1:
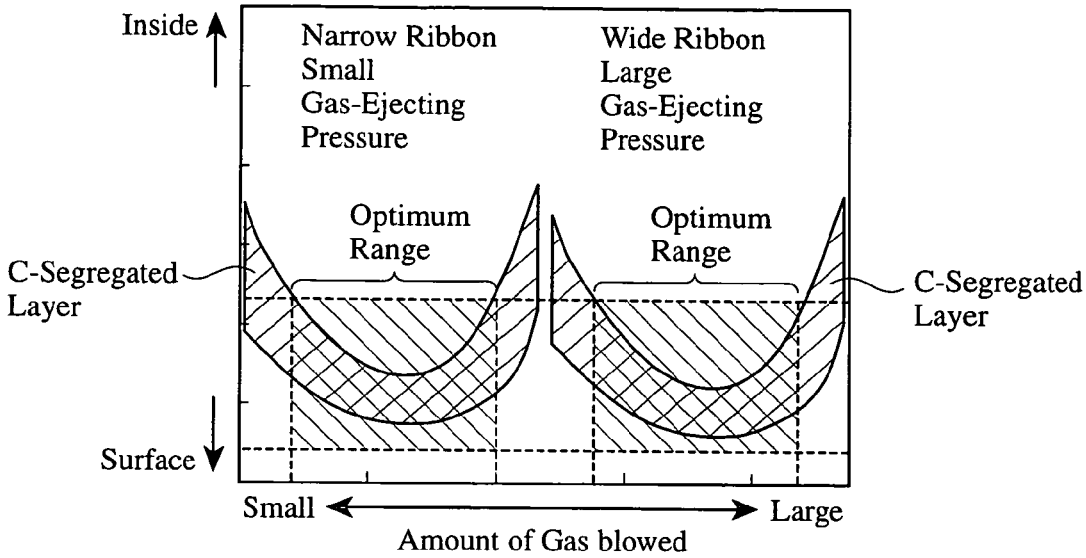
FIG. 1 is a schematic view showing the depth of a C-segregated layer changeable with the amount of a gas blown.

The amount a of Fe is 80 to 83 atomic %. When the amount of Fe is less than 76 atomic %, the Fe-based amorphous alloy ribbon does not have a sufficient saturation magnetic flux density Bs for magnetic cores. On the other hand, when it exceeds 83.5 atomic %, the Fe-based amorphous alloy ribbon has such reduced thermal stability that it cannot be produced stably. To obtain a high saturation magnetic flux density, a is preferably 80 to 83 atomic %. 50 atomic % or less of Fe may be substituted by Co and/or Ni. To achieve a high saturation magnetic flux density, the substituting amount is preferably 40 atomic % or less for Co and 10 atomic % or less for Ni.

Si is an element contributing to making the alloy amorphous. To have an improved saturation magnetic flux density Bs, the amount b of Si is 12 atomic % or less. To obtain a higher saturation magnetic flux density Bs, b is preferably 0.1 to 5 atomic %.

B is an element most contributing to making the alloy amorphous. The amount c of B is 14 to 18 atomic %, to provide the Fe-based amorphous alloy ribbon with a high saturation magnetic flux density Bs and thermal stability. When the amount c of B is less than 8 atomic %, the resultant Fe-based amorphous alloy ribbon has reduced thermal stability. On the other hand, even if it exceeds 18 atomic %, more effect of making the alloy amorphous is not obtained.

C is an element effective for improving a squareness ratio and a saturation magnetic flux density Bs. The amount d of C is 0.01 to 3 atomic %. When d is less than 0.01 atomic %, sufficient effects cannot be obtained. On the other hand, when it exceeds 3 atomic %, embrittlement and decrease in thermal stability occur in the resultant Fe-based amorphous alloy ribbon. The amount d of C is preferably 0.05 to 3 atomic %.

The alloy may contain 0.01 to 5 atomic % of at least one selected from the group consisting of Cr, Mo, Zr, Hf and Nb, and 0.5 atomic % or less of at least one inevitable impurity selected from the group consisting of Mn, S, P, Sn, Cu, Al and Ti.

The present invention has solved the problems of embrittlement, surface crystallization and decrease in a squareness ratio, which are caused by increasing the saturation magnetic flux density Bs in the Fe-based amorphous alloy ribbon. The saturation magnetic flux density Bs of the Fe-based amorphous alloy ribbon can be increased by various methods. However, when used for magnetic cores for transformers, etc., the problems of squareness ratio, embrittlement, surface crystallization, etc. should be solved altogether.

The addition of C leads to increase in a saturation magnetic flux density $B_S$, melt flowability and wettability with a roll. However, it generates a C-segregated layer, resulting in embrittlement and thermal instability and thus higher core loss at a high magnetic flux density. Accordingly, C has not been added intentionally in practical applications. As a result of research on the dependency of the distribution of C near surface on the amount of C added, it has been found that the control of a weight ratio of C to Si and the range and peak of the C-segregated layer makes it possible to provide the Fe-based amorphous alloy ribbon with high $B_{80}/B_S$, low core loss, and reduced embrittlement and thermal instability.

The formation of a C-segregated layer causes stress relaxation to occur near surface at low temperatures, effective particularly when the Fe-based amorphous alloy ribbon is wound to a toroidal core. A high stress relaxation rate results in high $B_{80}/B_S$ and thus reduced core loss at high magnetic flux densities. It is important that such effects can be obtained when the peak concentration of C exists in a controlled range from a surface.

If there is large surface roughness due to air pockets, etc., an oxide layer has an uneven thickness, resulting in the C-segregated layer provided with uneven depth and range. This makes stress relaxation uneven, partially generating brittle portions. In the C-segregated layer having thermal conductivity lowered by surface roughness, surface crystallization is accelerated, resulting in decreased $B_{80}/B_S$. Accordingly, it is important to control the surface roughness and form the C-segregated layer from surface in a uniform depth range. For this purpose, it is effective to blow a CO or $CO_2$ gas in a predetermined flow rate onto an alloy melt ejected onto a roll during casting.

The flow rate of the gas should be controlled such that the C-segregated layer is formed in a range of 2 to 20 nm from surface. FIG. 1 schematically shows the relation between the amount and ejection pressure of the gas blown onto the roll and the range of the C-segregated layer. When the ejection pressure of the gas is changed to adjust the width of the Fe-based amorphous alloy ribbon, the optimum amount of the gas blown is also changed. Accordingly, the amount of the gas blown should be determined in relation to the range of the C-segregated layer. When too small an amount of a gas is blown, the Fe-based amorphous alloy ribbon cannot be provided with sufficiently reduced surface roughness, resulting in the C-segregated layer displaced toward inside and provided with uneven thickness. On the other hand, too much gas affects the paddle of the alloy melt, thereby providing the C-segregated layer with uneven thickness and displacement toward inside due to the involvement of the gas, and further providing the ribbon with poor edges, etc. Thus, it is important to blow the gas in an optimum amount. The control of the amount of a gas blown drastically reduces surface roughness, thereby providing the C-segregated layer with uniform range, and thus providing the Fe-based amorphous alloy ribbon with improved stress relaxation rate and squareness ratio $B_{80}/B_S$, and further providing toroidal cores with reduced loss and suppressed surface crystallization and embrittlement. This enables the addition of C to exhibit sufficient effects.

Figure 2:
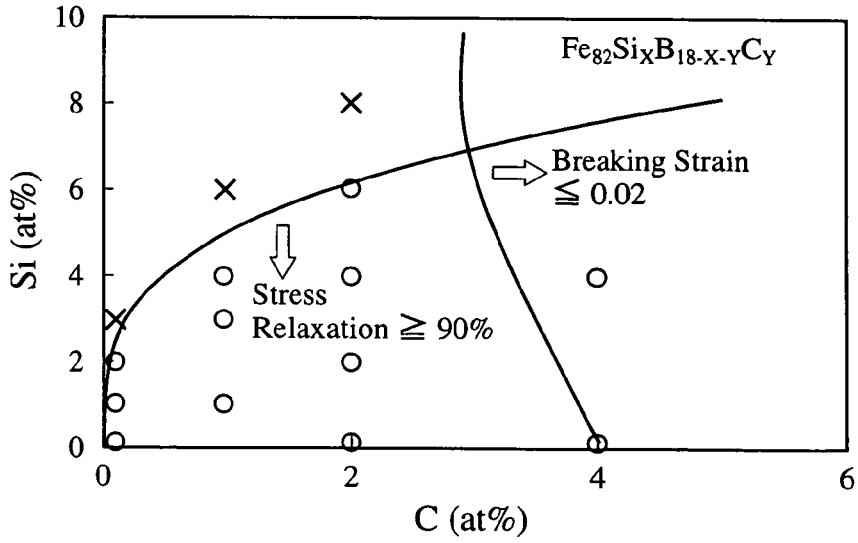
FIG. 2 is a graph showing the relation between stress relaxation and breaking strain and the concentrations of C and Si.

Better results are obtained by controlling surface conditions and a weight ratio of Si to C. Higher effects are obtained generally when a ratio of b/d is small, though they depend on the amount of C. FIG. 2 shows the relation between the amounts of C and Si and the stress relaxation rate and the maximum strain (breaking strain). In the Fe-based amorphous alloy ribbon containing 82 atomic % of Fe, the stress relaxation rate was 90% or more when $b \leqq 5 \times d^{1/3}$. The reason therefor is that the C-segregated layer has a high peak when the amount of Si is reduced at the same amount of C. Thus, the control of a weight ratio of Si to C to adjust the peak of the concentration of C can change the stress relaxation rate. When d is 3 atomic % or less, the Fe-based amorphous alloy ribbon has high stress relaxation rate and saturation magnetic flux density, most suitable for magnetic cores for transformers. Further, embrittlement, surface crystallization and decrease in thermal stability, which occur when a large amount of C is added, can be suppressed.

The present invention will be described in more detail referring to Examples below without intention of limiting the present invention thereto.

EXAMPLE 1

200 g of an alloy having a composition of $Fe_{82}Si_2B_{14}C_2$ was melted in a high-frequency furnace, and ejected through a nozzle of the furnace onto a copper roll rotating at 25-30 m/s while blowing a $CO_2$ gas from rear the nozzle, to produce Fe-based amorphous alloy ribbons having various widths of 5 mm, 10 mm and 20 mm, respectively, and a thickness of 23-25 μm. Each of the Fe-based amorphous alloy ribbons had a C-segregated layer at a depth of 2 to 20 nm from the surface. The Fe-based amorphous alloy ribbons were annealed at such temperatures as to minimize a core loss, which were within a range of 300 to 400° C. With the blowing rate of a $CO_2$ gas changed, measurement was conducted with respect to the properties of the Fe-based amorphous alloy ribbons. The results are shown in Table 1.

$B_S$ and $B_{80}$ were measured on single-plate samples, and a core loss $W_{13/50}$ at a magnetic flux density of 1.3 T and a frequency of 50 Hz, and a core loss $W_{14/50}$ at a magnetic flux density of 1.4 T and a frequency of 50 Hz were measured on toroidal cores of 25 mm in outer diameter and 20 mm in inner diameter, which were formed by the Fe-based amorphous alloy ribbons.

Figure 3:
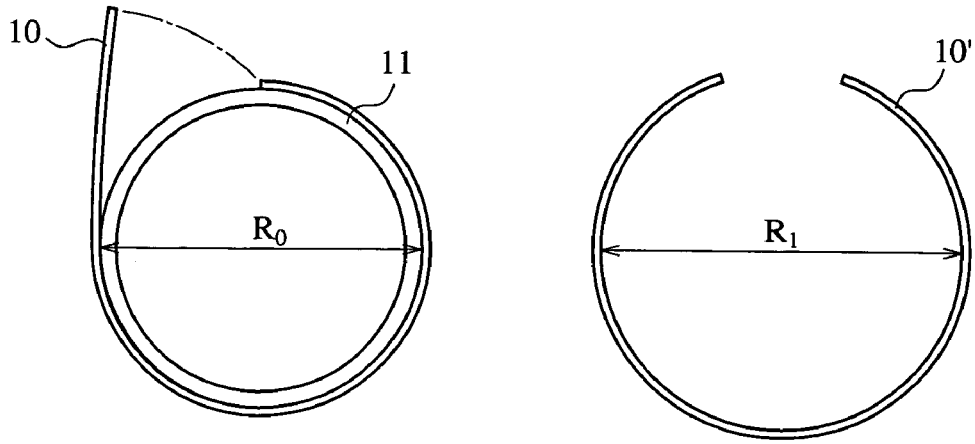
FIG. 3 is a schematic view showing the method of measuring a stress relaxation rate.

As shown in FIG. 3, each Fe-based amorphous alloy ribbon 10 cut to a length of 10.5 ($\pi \cdot R_0$) cm was wound around a quartz pipe 11 having a diameter of $R_0$ cm to form a single-plate sample and annealed under the same conditions as above to relax stress during working to a ring. A diameter $R_1$ of a circle corresponding to the C-shaped sample 10' freed from the quartz pipe 11 was measured to determine a stress relaxation rate Rs expressed by the formula: $Rs=(R_0/R_1)\times 100$ [%], as a parameter expressing to which extent stress is relaxed by the annealing (heat treatment). The stress relaxation rate Rs of 100% means that the stress is completely relaxed.

The breaking strain ϵ was calculated by the formula: $\epsilon=t/(2r-t)$, wherein t represents the thickness of the ribbon, and r represents a breaking radius in a bending test.

The region of the C-segregated layer was defined as a region having a higher concentration of C than in an inner region having a uniform concentration of C, which was determined by analyzing a roll-contacting surface of each sample by an Auger electron spectroscope. The highest C-concentration point in the C-segregated layer was regarded as a peak.

Figure 4:
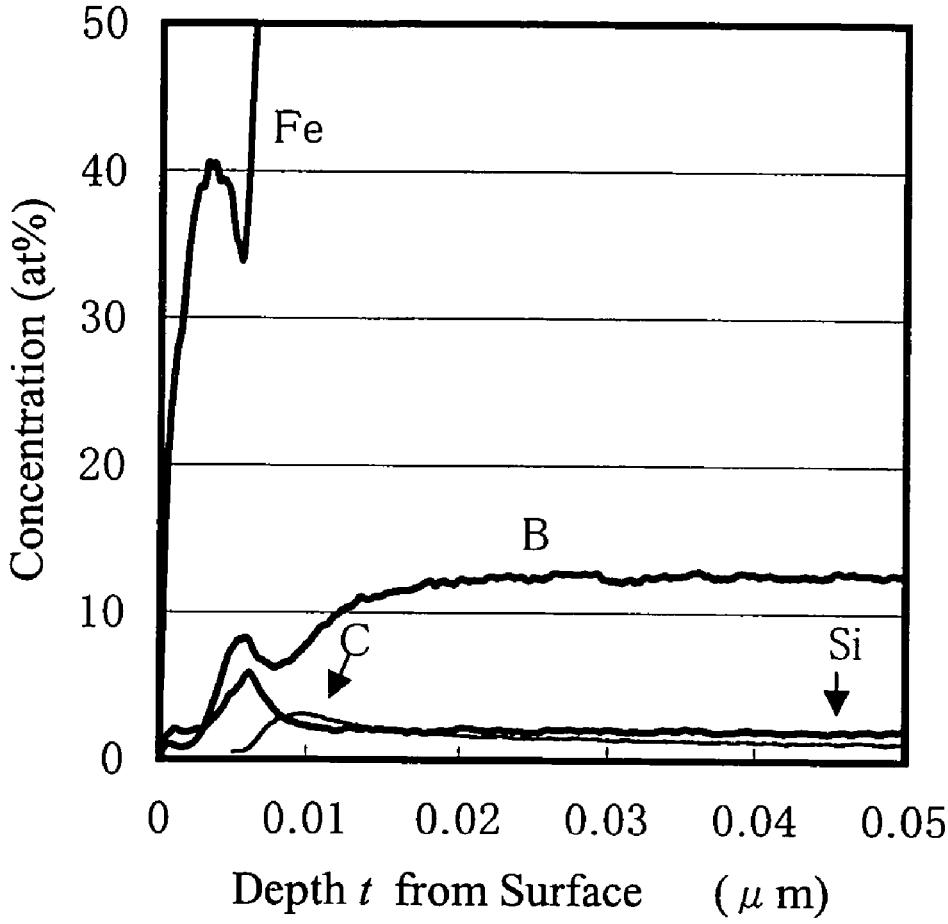
FIG. 4 is a graph showing the relations between the concentrations of elements and a depth from a roll-contacting surface of Sample 1.

The roll-contacting surface of Sample 1 was subjected to an element analysis in a depth direction by a glow-discharge optical emission spectroscope (GD-OES) available from Horiba, Ltd. The results are shown in FIG. 4.

To measure surface roughness, each Fe-based amorphous alloy ribbon was cut to a rectangular shape of 5 mm in width and 12 cm in length, and annealed in the same manner as above. The measured surface roughness was arithmetically averaged. The average surface roughness Ra of Samples 1 to 3 was 0.35.

TABLE 1

| Sample No. | Width (mm) | $B_{80}$ [T] | Bs [T] | $B_{80}/B_s$ (× 100%) | Rs (%) |
|---|---|---|---|---|---|
| 1 | 5 | 1.646 | 1.669 | 98.6 | 95 |
| 2 | 10 | 1.642 | 1.665 | 98.6 | 96 |
| 3 | 20 | 1.638 | 1.663 | 98.5 | 95 |

| Sample No. | Breaking Strain ϵ | Range of C-Segregated Layer (nm) | Peak of C Concentration (atomic %) | $W_{13/50}$ (W/kg) | $W_{14/50}$ (W/kg) |
|---|---|---|---|---|---|
| 1 | 0.048 | 5-16 | 3.2 | 0.152 | 0.227 |
| 2 | 0.030 | 5-16 | 3.0 | 0.159 | 0.239 |
| 3 | 0.025 | 6-18 | 2.8 | 0.157 | 0.247 |

COMPARATIVE EXAMPLE 1

The same alloy melt as in Example 1 was ejected through the nozzle under the same conditions as in Example 1 except for reducing the amount of a $CO_2$ gas blown, to produce Fe-based amorphous alloy ribbons having various widths of 5 mm, 10 mm and 20 mm, respectively, and a thickness of 23-25 μm. The resultant Fe-based amorphous alloy ribbons (Samples 4 to 6) had C-segregated layers beyond the depth range of 2-20 nm. The properties of Samples 4 to 6 are shown in Table 2. Samples 4 to 6 had an average surface roughness Ra of 0.78. Though Samples 4 to 6 were comparable to Samples 1 to 3 in $W_{13/50}$, Samples 4 to 6 were larger than Samples 1 to 3 by as much as 0.05 W/kg or more in $W_{14/50}$. Further, Samples 4 to 6 were lower than Samples 1 to 3 in breaking strain ϵ. Because of surface roughness, the C-segregated layers of Samples 4 to 6 were non-uniform, resulting in deteriorated properties.

TABLE 2

| Sample No. | Width (mm) | $B_{80}$ [T] | Bs [T] | $B_{80}/B_s$ (× 100%) | Rs (%) |
|---|---|---|---|---|---|
| 4 | 5 | 1.605 | 1.661 | 96.6 | 92 |
| 5 | 10 | 1.597 | 1.658 | 96.3 | 89 |
| 6 | 20 | 1.598 | 1.659 | 96.3 | 90 |

| Sample No. | Breaking Strain ϵ | Range of C-Segregated Layer (nm) | Peak of C Concentration (atomic %) | $W_{13/50}$ (W/kg) | $W_{14/50}$ (W/kg) |
|---|---|---|---|---|---|
| 4 | 0.034 | 7-23 | 2.6 | 0.162 | 0.293 |
| 5 | 0.019 | 7-24 | 2.3 | 0.168 | 0.325 |
| 6 | 0.017 | 8-24 | 2.4 | 0.166 | 0.319 |

EXAMPLE 2

Figure 5:
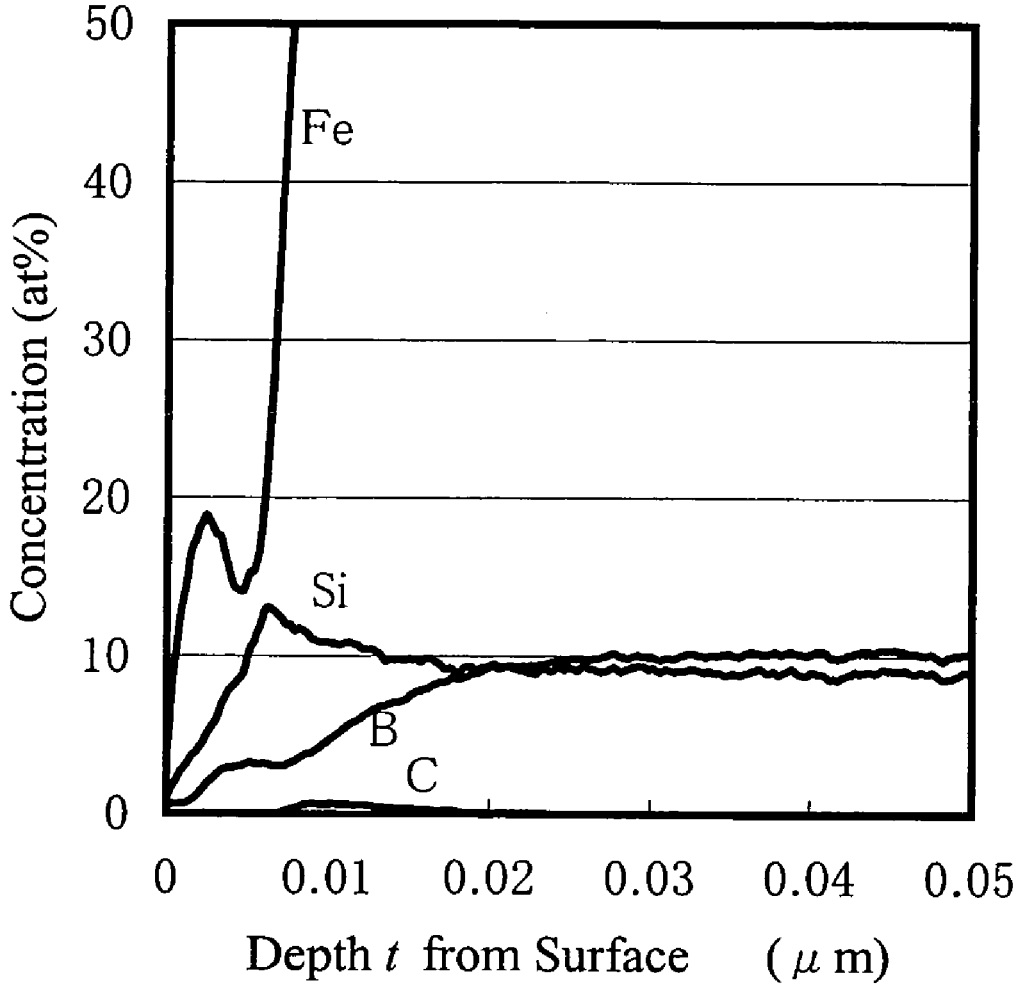
FIG. 5 is a graph showing the relations between the concentrations of elements and a depth from a roll-contacting surface of Sample 8.
Figure 6:
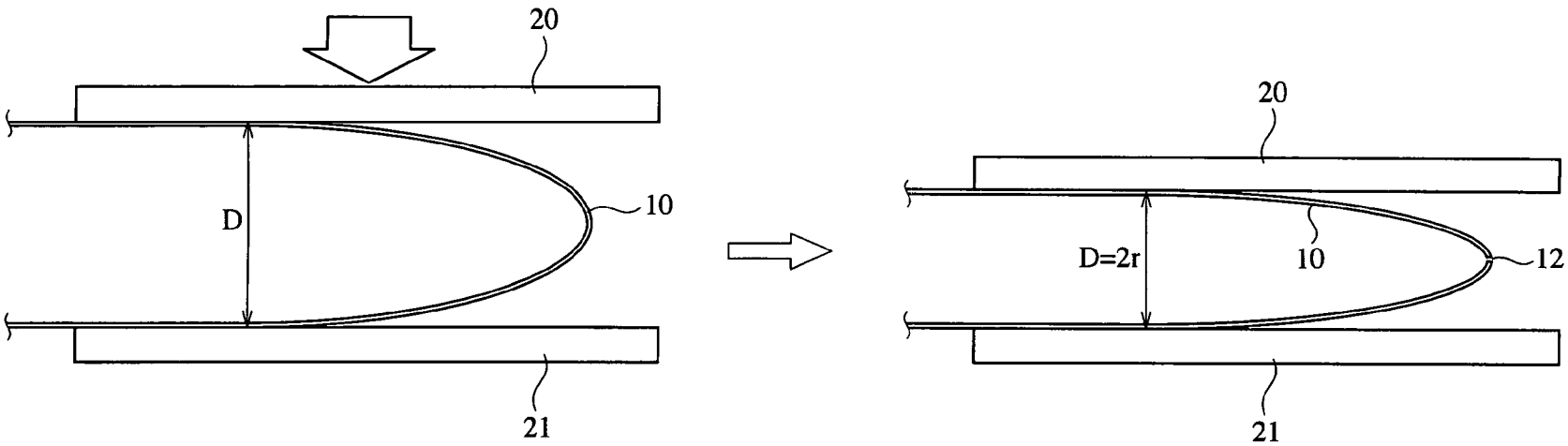
FIG. 6 is a schematic view showing the method of measuring a breaking strain.

200 g of alloy melts having compositions shown in Table 3 were rapidly quenched in the same manner as in Example 1 to form Fe-based amorphous alloy ribbons of 5 mm in width and 23-25 μm in thickness. The properties of each Fe-based amorphous alloy ribbon are shown in Table 3. The Fe-based amorphous alloy ribbons having high $B_{80}$ can keep low core loss at high operating magnetic flux densities. Reference Sample 2 was subjected to element analysis in a depth direction from its roll-contacting surface. The results are shown in FIG. 5. The average surface roughness Ra of Samples 7 to 15 and Reference Samples 1 to 9 was 0.38.

TABLE 3

| Sample No. | Composition Fe | Co | Ni | Si | B | C | $B_{80}$ [T] | Bs [T] | $B_{80}/B_S$ (×100%) |
|---|---|---|---|---|---|---|---|---|---|
| 7 | 82.0 | — | — | 2.0 | 16.0 | 0.05 | 1.609 | 1.632 | 98.6 |
| 8 | 82.0 | — | — | 0.1 | 17.8 | 0.1 | 1.625 | 1.655 | 98.2 |
| 9 | 82.0 | — | — | 1.0 | 16.9 | 0.1 | 1.635 | 1.665 | 98.2 |
| 10 | 82.0 | — | — | 2.0 | 15.9 | 0.1 | 1.615 | 1.643 | 98.3 |
| 11 | 82.0 | — | — | 1.0 | 16.0 | 1.0 | 1.640 | 1.661 | 98.7 |
| 12 | 82.0 | — | — | 3.0 | 14.0 | 1.0 | 1.638 | 1.659 | 98.7 |
| 13 | 82.0 | — | — | 0.1 | 15.9 | 2.0 | 1.639 | 1.666 | 98.4 |
| 14 | 80.0 | 2.0 | — | 2.0 | 16.0 | 0.1 | 1.656 | 1.689 | 98.0 |
| 15 | 80.0 | — | 2.0 | 2.0 | 16.0 | 0.1 | 1.633 | 1.665 | 98.1 |
| Ref. Sample No. | | | | | | | | | |
| 1 | 78.0 | — | — | 11.0 | 12.9 | 0.1 | 1.461 | 1.550 | 94.3 |
| 2 | 80.0 | — | — | 9.0 | 10.9 | 0.1 | 1.485 | 1.570 | 94.6 |
| 3 | 81.0 | — | — | 5.0 | 13.0 | 1.0 | 1.598 | 1.619 | 98.7 |

TABLE 3-continued

| | | | | | | | | | |
|---|---|---|---|---|---|---|---|---|---|
| 4 | 82.0 | — | — | 4.0 | 13.0 | 1.0 | 1.614 | 1.656 | 97.5 |
| 5 | 82.0 | — | — | 4.0 | 12.0 | 2.0 | 1.618 | 1.658 | 97.6 |
| 6 | 82.0 | — | — | 5.0 | 10.0 | 3.0 | 1.601 | 1.641 | 97.6 |
| 7 | 82.0 | — | — | 6.0 | 10.0 | 2.0 | 1.600 | 1.631 | 98.1 |
| 8 | 82.0 | — | — | 6.0 | 11.0 | 1.0 | 1.597 | 1.632 | 97.9 |
| 9 | 83.0 | — | — | 3.0 | 13.0 | 1.0 | 1.600 | 1.629 | 98.2 |

| Sample No. | Rs (%) | Breaking Strain ϵ | Range of C-Segregated Layer (nm) | Peak of C Concentration (atomic %) | $W_{13/50}$ (W/kg) | $W_{14/50}$ (W/kg) |
|---|---|---|---|---|---|---|
| 7 | 91 | 0.030 | 5-15 | 0.8 | 0.171 | 0.260 |
| 8 | 92 | 0.048 | 6-19 | 1.3 | 0.177 | 0.252 |
| 9 | 92 | 0.030 | 7-18 | 1.0 | 0.167 | 0.242 |
| 10 | 90 | 0.048 | 5-17 | 0.9 | 0.175 | 0.272 |
| 11 | 94 | 0.041 | 7-16 | 1.8 | 0.163 | 0.238 |
| 12 | 90 | 0.030 | 7-15 | 1.6 | 0.166 | 0.241 |
| 13 | 95 | 0.026 | 6-17 | 3.5 | 0.158 | 0.233 |
| 14 | 91 | 0.029 | 6-18 | 1.0 | 0.179 | 0.229 |
| 15 | 91 | 0.027 | 6-17 | 0.8 | 0.177 | 0.234 |
| Ref. Sample No. | | | | | | |
| 1 | 82 | 0.020 | 6-19 | 0.6 | 0.165 | 0.297 |
| 2 | 86 | 0.021 | 6-19 | 0.7 | 0.170 | 0.289 |
| 3 | 89 | 0.040 | 7-15 | 1.3 | 0.176 | 0.279 |

TABLE 3-continued

| | | | | | | |
|---|---|---|---|---|---|---|
| 4 | 91 | 0.034 | 8-16 | 1.4 | 0.178 | 0.257 |
| 5 | 92 | 0.068 | 6-17 | 3.0 | 0.177 | 0.252 |
| 6 | 91 | 0.024 | 7-15 | 3.8 | 0.169 | 0.268 |
| 7 | 90 | 0.031 | 6-16 | 2.8 | 0.179 | 0.292 |
| 8 | 85 | 0.026 | 7-14 | 1.4 | 0.172 | 0.299 |
| 9 | 88 | 0.048 | 7-16 | 1.6 | 0.170 | 0.259 |

COMPARATIVE EXAMPLE 2

Fe-based amorphous alloy ribbons having compositions shown in Table 4 were produced in the same manner as in Example 1. Their properties are shown in Table 4. The Fe-based amorphous alloy ribbons containing 4 atomic % of C suffered from large embrittlement and low thermal stability and squareness ratio despite high stress relaxation rates. Further, those containing a large amount of Si had low stress relaxation rates and saturation magnetic flux density, resulting in large core loss at high operating magnetic flux densities.

TABLE 4

| Sample No. | Composition Fe | Si | B | C | $B_{80}$ [T] | Bs [T] | $B_{80}/B_s$ (× 100%) |
|---|---|---|---|---|---|---|---|
| 16 | 82.0 | 0.1 | 13.9 | 4.0 | 1.600 | 1.661 | 96.3 |
| 17 | 82.0 | 4.0 | 10.0 | 4.0 | 1.572 | 1.629 | 96.5 |
| 18 | 84.0 | 1.0 | 14.0 | 1.0 | 1.579 | 1.619 | 97.5 |
| 19 | 84.0 | 5.0 | 8.0 | 3.0 | 1.510 | 1.610 | 93.8 |

| Sample No. | Rs (%) | Breaking Strain ϵ | Range of C-Segregated Layer (nm) | Peak of C Concentration (atomic %) | $W_{13/50}$ (W/kg) | $W_{14/50}$ (W/kg) |
|---|---|---|---|---|---|---|
| 16 | 98 | 0.012 | 6-16 | 5.6 | 0.185 | 0.310 |
| 17 | 91 | 0.009 | 7-18 | 4.9 | 0.179 | 0.322 |
| 18 | 93 | 0.030 | 7-17 | 1.5 | 0.204 | 0.385 |
| 19 | 82 | 0.018 | 6-15 | 3.4 | 0.250 | 0.420 |

With the weight ratio of Si to C restricted within a predetermined range and with reduced surface roughness, the Fe-based amorphous alloy ribbons can have C-segregated layers with controlled range and peak in a depth direction, resulting in reduced embrittlement, high magnetic flux densities, squareness ratios and thermal stability, and low core loss. The C-segregated layer enables stress relaxation near surface at low temperatures, effective for stress relaxation when wound to toroidal cores. Such Fe-based amorphous alloy ribbons are particularly suitable for magnetic cores for transformers.

What is claimed is:

1. An Fe-based amorphous alloy ribbon having a composition comprising $Fe_aSi_bB_cC_d$ and inevitable impurities, wherein a is 80 to 83 atomic %, b is 0.1 to 5 atomic %, c is 14 to 18 atomic %, and d is 0.01 to 3 atomic %, the concentration distribution of C measured radially from both surfaces to the inside of said Fe-based amorphous alloy ribbon having a peak within a depth of 2 to 20 nm.

2. The Fe-based amorphous alloy ribbon according to claim 1, wherein said Fe-based amorphous alloy ribbon has a saturation magnetic flux density of 1.60 to 1.689 T after annealing.

3. The Fe-based amorphous alloy ribbon according to claim 1 or 2, wherein a, b and d meet the condition of $b=(0.5\times a-36)\times d^{1/3}$.

4. The Fe-based amorphous alloy ribbon according to claim 1 or 2, wherein its magnetic flux density in a magnetic field of 80 A/m is 1.55 to 1.66 T after annealing.

5. The Fe-based amorphous alloy ribbon according to claim 1 or 2, wherein an annealed toroidal core constituted by said Fe-based amorphous alloy ribbon has a core loss $W_{14/50}$ of 0.227 to 0.28 W/kg at a magnetic flux density of 1.4 T and a frequency of 50 Hz.

6. The Fe-based amorphous alloy ribbon according to claim 1 or 2, wherein its breaking strain $\epsilon$ is 0.02 to 0.05 after annealing.

7. The Fe-based amorphous alloy ribbon according to claim 1, wherein 50 atomic % or less of Fe is substituted by Co and/or Ni.

8. The Fe-based amorphous alloy ribbon according to claim 3, wherein its magnetic flux density in a magnetic field of 80 A/m is 1.55 to 1.66 T after annealing.

9. The Fe-based amorphous alloy ribbon according to claim 3, wherein an annealed toroidal core constituted by said Fe-based amorphous alloy ribbon has a core loss $W_{14/50}$ of 0.227 to 0.28 W/kg at a magnetic flux density of 1.4 T and a frequency of 50 Hz.

10. The Fe-based amorphous alloy ribbon according to claim 4, wherein an annealed toroidal core constituted by said Fe-based amorphous alloy ribbon has a core loss $W_{14/50}$ of 0.227 to 0.28 W/kg at a magnetic flux density of 1.4 T and a frequency of 50 Hz.

11. The Fe-based amorphous alloy ribbon according to claim 3, wherein its breaking strain $\epsilon$ is 0.02 to 0.05 after annealing.

12. The Fe-based amorphous alloy ribbon according to claim 4, wherein its breaking strain $\epsilon$ is 0.02 to 0.05 after annealing.

13. The Fe-based amorphous alloy ribbon according to claim 5, wherein its breaking strain $\epsilon$ is 0.02 to 0.05 after annealing.

* * * * *

UNITED STATES PATENT AND TRADEMARK OFFICE

CERTIFICATE OF CORRECTION

PATENT NO. : 7,425,239 B2
APPLICATION NO. : 11/059303
DATED : September 16, 2008
INVENTOR(S) : Yuichi Ogawa et al.

It is certified that error appears in the above-identified patent and that said Letters Patent is hereby corrected as shown below:

First Page, Column 1 (Title), Line 1, change “FE” to --Fe--.

Column 1 (Title), Line 1, change “FE” to --Fe--.

Column 2, Line 31, change “less” to --less,--.

Column 2, Line 50, change “ξ” to --ε--.

Column 3, Line 24, change “Bs” to --$B_s$--.

Column 3, Line 34, change “Bs,” to --$B_s$,--.

Column 3, Line 35, change “Bs,” to --$B_s$,--.

Column 3, Line 40, change “Bs” to --$B_s$--.

Column 3, Line 46, change “Bs.” to --$B_s$.--.

Column 3, Line 60, change “Bs” to --$B_s$--.

Column 3, Line 61, change “Bs” to --$B_s$--.

Column 6 (Table 1), Line 2 change “Bs” to --$B_s$--.

Column 6 (Table 2), Line 40, change “Bs” to --$B_s$--.

Column 7 (Table 3), Line 2, change “Bs” to --$B_s$--.

UNITED STATES PATENT AND TRADEMARK OFFICE

CERTIFICATE OF CORRECTION

PATENT NO. : 7,425,239 B2
APPLICATION NO. : 11/059303
DATED : September 16, 2008
INVENTOR(S) : Yuichi Ogawa et al.

It is certified that error appears in the above-identified patent and that said Letters Patent is hereby corrected as shown below:

Column 8 (Table 4), Line 1, change "Bs" to --$B_s$--.

Signed and Sealed this

Thirteenth Day of January, 2009

JON W. DUDAS
*Director of the United States Patent and Trademark Office*